US006672329B1

(12) United States Patent
Brooks et al.

(10) Patent No.: US 6,672,329 B1
(45) Date of Patent: Jan. 6, 2004

(54) IN-WALL RETRACTABLE WATER HOSE ASSEMBLY

(76) Inventors: Rodney Brooks, 3773 Timberglen Apt. 211, Dallas, TX (US) 75287; Robert Murphey, 1705 Bluebonnet, Denison, TX (US) 75020

( * ) Notice: Subject to any disclaimer, the term of this patent is extended or adjusted under 35 U.S.C. 154(b) by 0 days.

(21) Appl. No.: 10/270,388

(22) Filed: Oct. 11, 2002

(51) Int. Cl.[7] ..... B65H 75/34

(52) U.S. Cl. ..... 137/355.2; 137/355.26; 137/360; 242/390.8

(58) Field of Search ..... 137/355.26, 355.2, 137/355.16, 357, 360; 242/390.8

(56) References Cited

U.S. PATENT DOCUMENTS 1,878,537 A * 9/1932 Phister et al. ..... 137/357
2,599,423 A * 6/1952 Ziegler ..... 137/355.2
2,606,067 A * 8/1952 Roark ..... 137/355.16
4,513,772 A * 4/1985 Fisher ..... 137/355.22
5,568,824 A * 10/1996 Cordrey ..... 137/355.27
5,678,596 A 10/1997 Corallo ..... 137/357
5,983,923 A 11/1999 Hobbs et al. ..... 137/360
6,182,327 B1 2/2001 Gosselin ..... 15/315

* cited by examiner

*Primary Examiner*—A. Michael Chambers
(74) *Attorney, Agent, or Firm*—Goldstein & Lavas, P.C.

(57) ABSTRACT

An in-wall retractable water hose assembly for retracting and storing a water hose, having a housing located within a dwelling and an insulated front access door for providing access to the hose from outside the dwelling. A reel assembly is mounted within the housing on which the water hose is spooled, and a motor connected to the reel assembly effects rotation of the reel. A power box is positioned within the housing and has a power switch in communication with the motor. A movable casing is mounted on the reel assembly, the casing having a channel for accommodating the water hose. Movement of the casing along the reel assembly determines the positioning of the hose and maintains an even distribution of the hose along the reel. A stabilizing bar prevents wobbling of the casing during retraction of the water hose.

4 Claims, 4 Drawing Sheets

IN-WALL RETRACTABLE WATER HOSE ASSEMBLY

BACKGROUND OF THE INVENTION

The invention relates to an in-wall retractable water hose assembly. In particular, the invention comprises a housing for storing a hose within a dwelling and a door for accessing the hose from outside the dwelling. A motor serves to retract the hose around a spool within the housing.

Water hoses are typically found around almost every home and are used for providing water to locations around a house or building. The hose is normally kept on the side of the house, adjacent to a hose bib, and is wound around a reel for easy storage. During use, a length of hose is pulled off of the reel in order to allow the user to reach a desired area. After use, the user has to manually toll up the hose on the reel.

Besides creating an eyesore on the side of a house, the hose is normally dirty from coming into contact with dirt, mud and grass. Further, in colder regions, a home owner has to detach the hose during low temperature; otherwise, any water left within the length of the hose may freeze, thereby damaging the hose.

Thus, there exists a need for an in-wall retractable water hose assembly that eliminates the need to manually roll up the hose. Further, such an assembly is stored within a dwelling and has a front access door for retrieving the hose contained therein. This prevents damage to the hose caused by cold weather, as well as eliminating the presence of the hose on the side of the house.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved in-wall retractable water hose assembly. As such, the general purpose of the present invention, which will be described subsequently in greater detail, is to provide a new and improved in-wall retractable water hose assembly which has all the advantages of the prior art and none of the disadvantages.

To attain this, the present invention essentially comprises an in-wall retractable water hose assembly for retracting and storing a water hose, having a housing, a reel assembly mounted within the housing on which the water hose is spooled, and a motor connected to the reel assembly for effecting rotation of the reel. The housing is located within a dwelling and has an insulated front access door for providing access to the hose. A power box is positioned within the housing and has a power switch in communication with the motor. The reel assembly has a reel, an advancing rod, a stabilizing bar, and a belt positioned between the advancing rod and the motor. A coil extends around the advancing rod and rotates with the rod. A movable casing is mounted on the advancing rod, the casing having a channel for accommodating the water hose. Rotation of the coil and rod causes the casing to move along the rod. The movement of the casing determines the positioning of the hose and maintains an even distribution of the hose along the reel. The stabilizing bar prevents wobbling of the casing during retraction of the water hose.

It is an object of the invention to produce an in-wall retractable water hose assembly that allows the user eliminate the presence of a hose on the outside of a dwelling, as well as reduce the exposure of the hose to inclement and cold weather. Accordingly, the assembly comprises a housing in which the hose is stored when not in use, said housing is positioned within a dwelling. An insulated front door provides access to the hose within the housing.

It is a further object of the invention to produce an in-wall retractable water hose assembly that allows the user to retract the hose without having to manually roll up the hose on its reel. Accordingly, the assembly comprises a motor that effects rotation of the reel. By depressing a button that engages the motor, a reel in turn rotates, thereby rolling up the hose thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
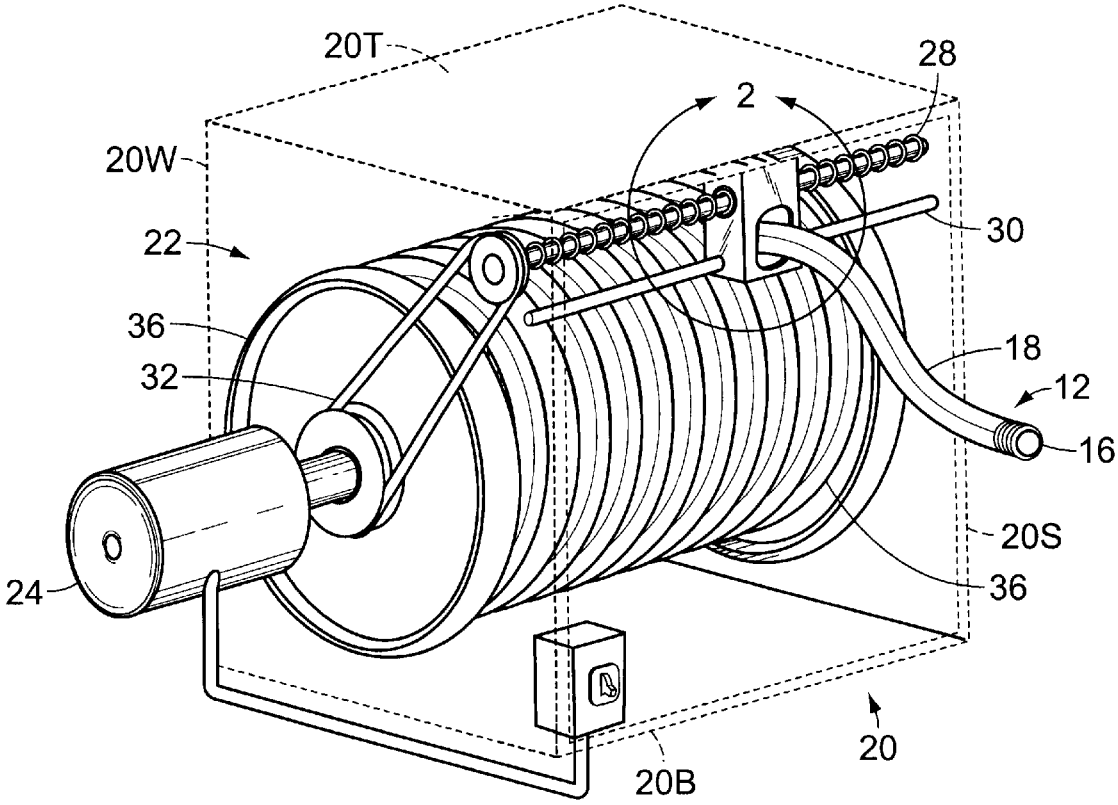
FIG. 1 is a perspective view of the retractable water hose assembly.

10 in-wall retractable water hose assembly
11 dwelling
11W dwelling outside wall
11C dwelling inside compartment
12 water hose
14 water hose coupling end
16 water hose free end
18 water hose length
20 housing
20T housing top wall
20B housing bottom wall
20W housing back wall
20S housing side wall
22 reel assembly
24 motor
26 reel
28 advancing rod
30 stabilizing bar
32 belt
34 housing front door
36 reel end plate
38 coil
40 casing
40T casing top portion
40B casing bottom portion
40F casing front
40R casing rear
42 casing channel

44 advancing rod wheel
46 motor wheel
48 cord
50 power box
52 power switch

DETAILED DESCRIPTION OF THE PREFERRED EMBODIMENTS

FIG. 1 illustrates an in-wall retractable water hose assembly 10 for retracting and storing a water hose 12 within a dwelling 11. The dwelling 11 has an outside wall 11W and an inside compartment 11C extending from the outside wall 11W to a point within the dwelling 11. The water hose 12 has a coupling end 14 for engagement with a water supply, a free end 16 for dispensation of water, and a hose length 18 extending therebetween. The in-wall retractable water hose assembly 10 essentially comprises a housing 20 positioned within the dwelling inside compartment 11C, a reel assembly 22 mounted within the housing 20 on which the water hose 12 is spooled, and a motor 24 in communication with the reel assembly 22 for effecting rotation thereon.

Figure 4:
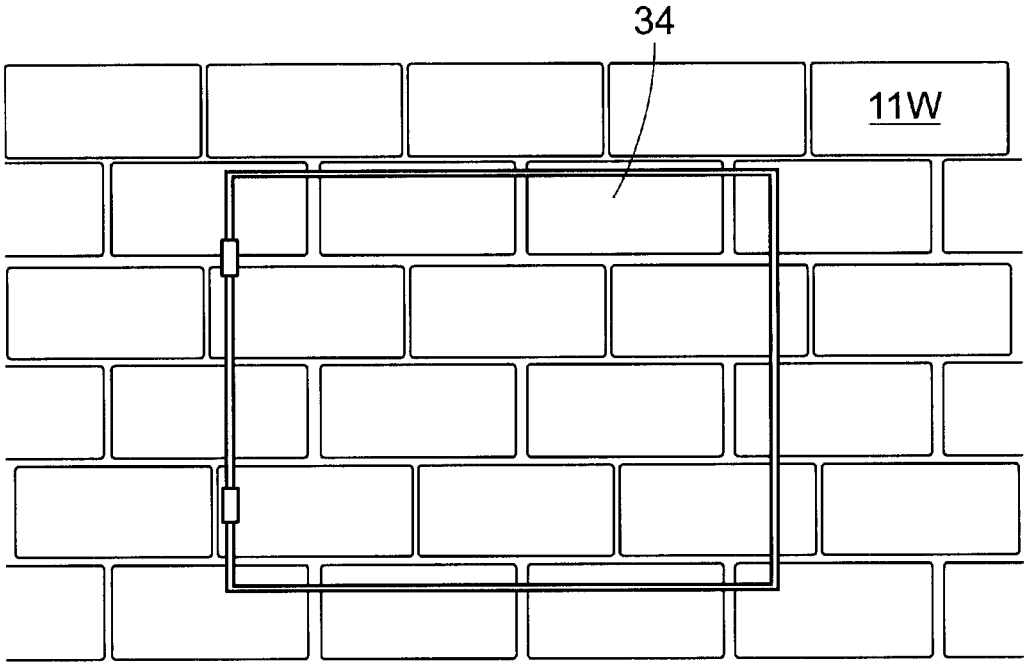
FIG. 4 is a front elevational view of the front door of the housing.

The housing 20 comprises a top wall 20T, a bottom wall 20B, a back wall 20W, and two side walls 20S. A front door 34 is hingedly attached to one of the side walls 20S. The front door 34 provides access to the hose 12 contained therein, and may be insulated to protect the contents therein from damage caused by severe weather conditions. Further, the front door 34, when in the closed position, is flush with the dwelling outside wall 11W, as illustrated in FIG. 4. Thus, the front door 34 may be constructed to have a similar appearance to the outside finish of the dwelling in order to allow the housing 20 to be camouflaged. The motor 24 is situated outside of the housing 20, but also within the dwelling 11, alongside one of the side walls 20S. A power box 50 is positioned within the housing 20, preferably along the bottom wall 20B, said box 50 having a power switch 52 in communication with the motor 24.

The reel assembly 22 comprises a reel 26, an advancing rod 28, a stabilizing bar 30, and a belt 32 positioned between the advancing rod 28 and the motor 24. The reel 26 has a pair of end plates 32 on either side of said reel 26. The end plates 36 are secured to the housing side walls 20S, thereby holding the reel 26 in place within the housing 20. The end plates 36 each have a diameter larger than the reel 26 in order to prevent the water hose 12 wound on the reel 26 from unraveling therefrom. The advancing rod 28 extends between the housing side walls 20S, near the top wall 20T. The advancing rod 28 has a coil 38 extending therearound, said coil 28 capable of rotation about the rod 28. The stabilizing bar 30 also extends across the housing 20, from the side walls 20S, said stabilizing bar substantially parallel to the advancing rod 28.

Figure 2:
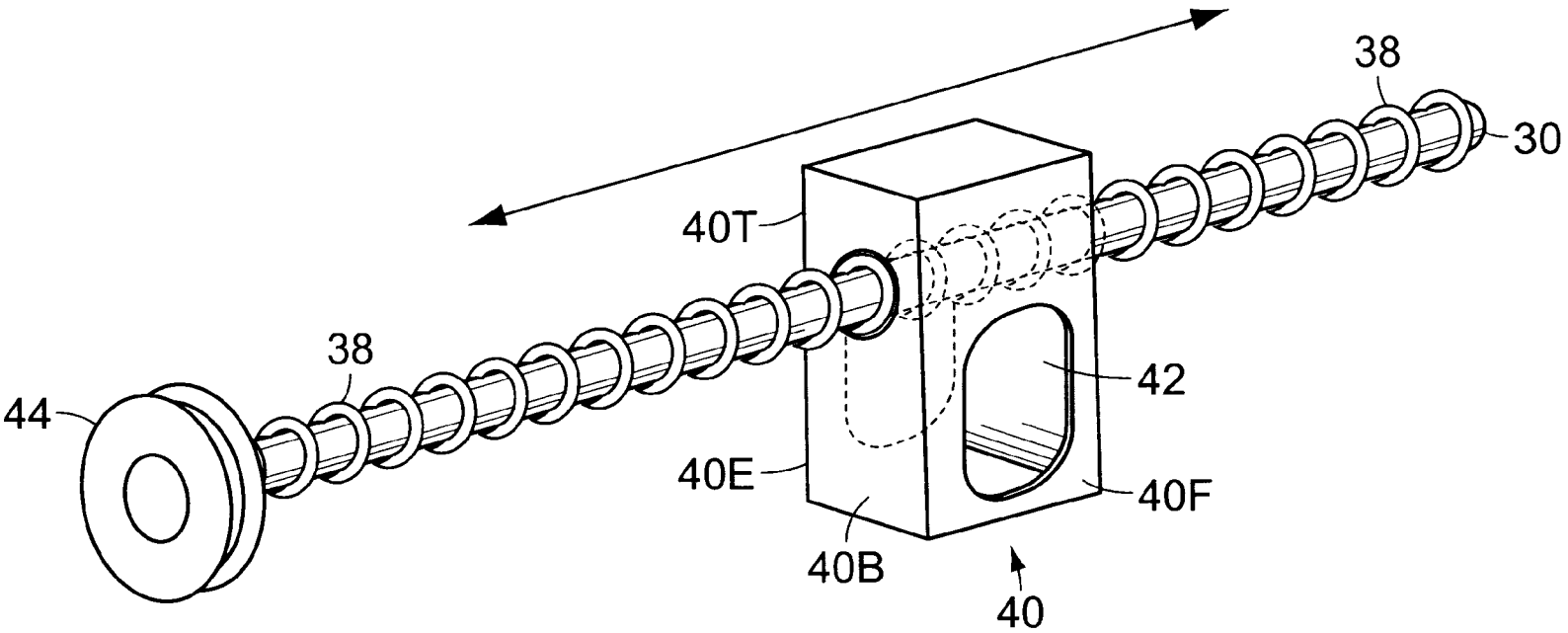
FIG. 2 is a perspective view of the advancing rod taken along circle 2 in FIG. 1.
Figure 3:
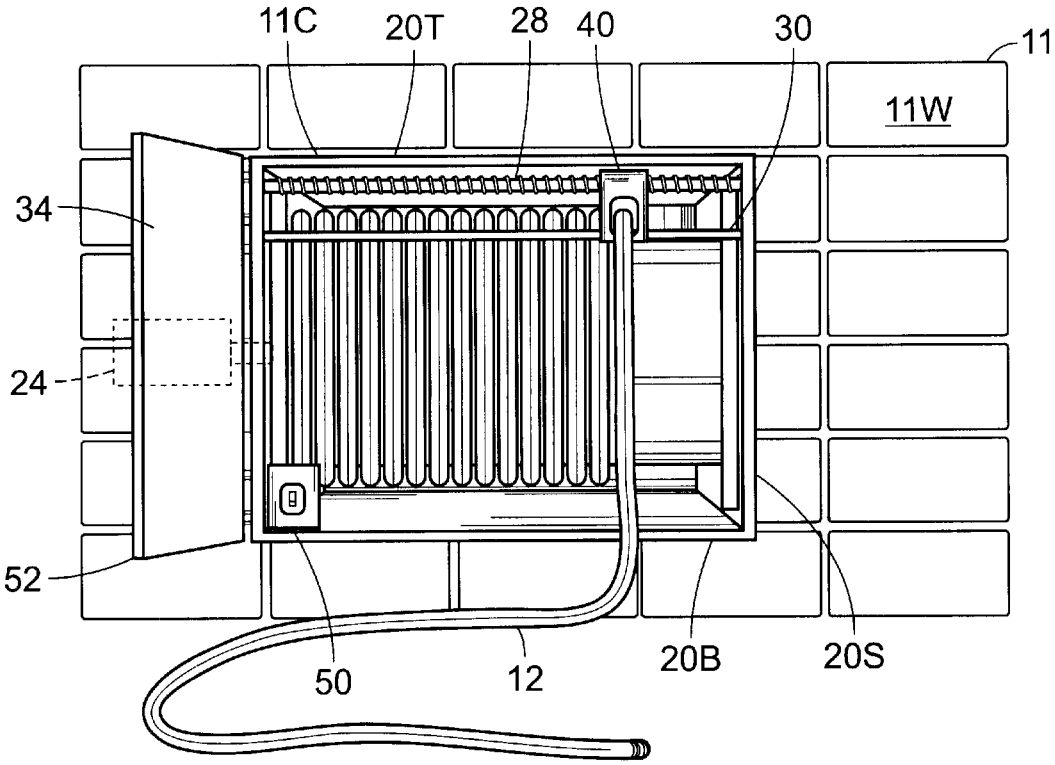
FIG. 3 is a front elevational view of the retractable water hose assembly within the housing, wherein the housing is positioned within a building.

The reel assembly 22 further comprises a movable casing 40 mounted on the advancing rod 28, as illustrated in FIG. 2. The movable casing 40 has a top portion 40T, a bottom portion 40B, a rear 40R, and a front 40F, wherein the advancing rod 28 extends transversely through the casing top portion 40T, and the stabilizing bar 30 extends transversely through the casing bottom portion 40B. A channel 42 runs through the casing 40, from the rear 40R to the front 40F, said channel 42 situated between the advancing rod 28 and the stabilizing 30. The channel 42 is sized to accommodate the water hose 12 therethrough. The casing 40 moves longitudinally along the length of the advancing bar 28, thus determining the positioning of the water hose 12 around the reel 26 as the hose becomes wound upon the reel, as will be described in greater detail hereinafter.

The belt 32 extends between the motor 24 and the advancing rod 28, said belt 32 having an advancing rod wheel 44, a motor wheel 46, and a cord 48 extending between the wheels 44, 46. Upon activation of the motor 24, the belt 32 causes the advancing bar 28 to rotate, thus simultaneously causing the coil 38 around the bar 28 to also rotate. As the coil 38 rotates, the casing 40 is moved across the advancing rod 28.

In use, the front door 34 is opened and the water hose 12 spooled around the reel 26 is pulled from housing 20 for use. The hose free end 16 is threaded through the channel 42 in the casing 40, wherein water is dispensed from said free end 16. After use, the water hose 12 is retracted into the housing 20 by engaging the motor 24. The power switch 52 is activated, thereby causing the motor 24 to engage the belt 32. The belt 32 causes the advancing rod 28, along with the coil 38 therearound, to rotate. Rotation of the coil 38 forces the casing 40 to move along the advancing rod 28 from one side of the housing 20 to the opposite side. While the advancing rod 28 rotates, the reel 26 also rotates in the same direction as said rod 28. Thus, this simultaneous rotation spools the water hose 12 around the reel 26. The movement of the casing 40 determines the positioning of the hose 12 and maintains an even distribution. The stabilizing bar 30 prevents wobbling of the casing 40 during retraction of the water hose 12. Once the hose 12 is completely retracted, the front door 34 may be closed to conceal the housing 20 and produce a flush effect with the dwelling outside wall 11W.

In conclusion, herein is presented an in-wall retractable water hose assembly located within a dwelling. The invention is illustrated by example in the drawing figures, and throughout the written description. It should be understood that numerous variations are possible, while adhering to the inventive concept. Such variations are contemplated as being a part of the present invention.

What is claimed is:

1. An in-wall retractable water hose assembly for retracting and storing a water hose within a dwelling, the dwelling having an outside wall and an inside compartment, comprising:

a housing, the housing located within the dwelling inside compartment, said housing having a top wall, a bottom wall, a back wall, two side walls, and a front door hingedly attached to one of the side walls, said front door being flush with the dwelling outside wall when the front door is closed, for allowing access to the hosing from outside the dwelling;

a motor;

a reel assembly mounted within the housing, the reel assembly having a reel, an advancing rod, a belt and a stabilizing bar, the motor being attached to the reel for causing the water hose to be spooled about the reel, the advancing rod having a coil extending there around, the advancing rod extending between the housing side walls near the housing top wall, the belt being positioned between the advancing rod and the motor, the stabilizing bar extending from the housing side walls across the housing in a direction substantially parallel to the advancing rod, wherein the advancing rod and coil rotate simultaneously upon activation by the motor, and wherein the advancing rod is positioned substantially above the reel in order to guide the positioning of the water hose around the reel; and a power box in communication with the motor for activating said motor, the power box having a power switch that can be selectively activated by a user.

2. The in-wall retractable water hose assembly as recited in claim 1, wherein the reel assembly further comprises a movable casing mounted on the advancing rod, the casing having a top portion, a bottom portion, a rear, a front, and a channel running through the casing from the rear to the front, said channel sized to accommodate the water hose therethrough, wherein the advancing rod extends transversely through the casing top portion and the stabilizing bar extends transversely through the casing bottom portion, substantially parallel to the advancing rod, the channel being situated between the advancing rod and stabilizing bar and extending perpendicular thereto, wherein the casing moves longitudinally along the length of the advancing bar, thus movement of the casing determines the positioning of the hose around the reel as the hose becomes wound upon the reel and thus maintains an even distribution there around.

3. The in-wall retractable water hose assembly as recited in claim 2, further comprising an advancing rod wheel mounted on the advancing rod, a motor wheel mounted on the motor, wherein the belt connects said wheels, wherein upon activation of the motor and rotation of the motor wheel, the belt causes the advancing bar to rotate, thus simultaneously causing the advancing bar coil to rotate, moving the casing across the advancing rod.

4. The in-wall retractable water hose assembly as recited in claim 3, wherein the reel further comprises a pair of end plates for securing the reel to the housing side walls, thereby holding the reel in place, wherein the end plates each having a larger diameter than the reel in order to prevent the water hose from unraveling therefrom.

* * * * *